United States Patent [19]

Adleman

[11] Patent Number: 4,905,557

[45] Date of Patent: Mar. 6, 1990

[54] NON-CIRCULAR SLUG SPLITTER PUNCH

[75] Inventor: Larry Adleman, Rockford, Ill.

[73] Assignee: Greenlee Textron Inc., Rockford, Ill.

[21] Appl. No.: 235,368

[22] Filed: Aug. 23, 1988

[51] Int. Cl.[4] ..... B26F 1/14

[52] U.S. Cl. ..... 83/681; 83/688; 83/689; 30/360

[58] Field of Search ..... 83/681, 684, 685, 686, 83/688, 689, 687; 30/360

[56] References Cited

U.S. PATENT DOCUMENTS

| | | | |
|---|---|---|---|
| 294,991 | 3/1884 | Goodman et al. | 83/689 |
| 389,404 | 9/1888 | O'Neill | 83/686 |
| 2,214,701 | 9/1940 | Scull | 164/124 |
| 3,296,905 | 1/1967 | Killaly | 83/685 |
| 4,353,164 | 10/1982 | Linquist et al. | 30/360 |
| 4,543,722 | 10/1985 | Adleman et al. | 30/360 |

*Primary Examiner*—Frank T. Yost
*Assistant Examiner*—Rinaldi Rada
*Attorney, Agent, or Firm*—R. A. Giangiorgi

[57] ABSTRACT

The punch comprises peripheral cutting edges and lateral cutting edges. The peripheral edges cut a slug in the desired shape, for examples, rectangular, square, oval, trapezoidal, D and double D-shaped, etc. while the lateral edges cut transversely from one peripheral edge to an opposite peripheral edge, thereby splitting the slug. Lateral cutting edges provide a dividing line across the working face. Surfaces and cutting edges on each side of the dividing line are similar and canted at opposite angles. Lateral cutting edges and peripheral cutting edges at their juncture provide pyramidal cutting sections which initially pierce the workpiece and initiate lateral slug splitting. This split grows from the slug periphery toward the center. Splitting is complete before a substantial portion of the slug periphery is cut.

19 Claims, 5 Drawing Sheets

NON-CIRCULAR SLUG SPLITTER PUNCH

BACKGROUND OF THE INVENTION

This invention relates generally to a punch and die apparatus for removing a slug from sheet metal and the like, and more particularly to a male punch member for removing a non-round slug in at least two pieces from sheet metal, and the like. U.S. Pat. Nos. 4,543,722 and 4,353,164 are for draw punches which split a circular slug into two substantially equal parts during the process of forming a round hole in sheet metal. These patents and this application are commonly owned and the patents are incorporated herein in their entirety by reference.

In use, a punch and die are axially aligned with a sheet metal workpiece located therebetween. The punch and die are brought closer and closer together until the punch is recessed into the die cavity. In the process, the sheet metal is sheared by the cutting edges of the punch moving relative to a correspondingly shaped aperture of the die cavity. A disadvantage of these known draw punch constructions and operations is that prior to the development of the slug splitter punch, removal of the slug from the female die member was often difficult and time-consuming. Frequently, another tool such as a screw driver must be used to free the punched slugs. The above-cited patents eliminated this problem by splitting the slug along a diametral line into two semi-circular pieces, when forming circular holes in the workpiece.

Many openings to be formed in sheet metal are non-round. Square, oval, elongated rectangular and trapezoidal openings, for example, to receive connector sockets in computer housings, have become more common and punches have been developed to meet these applications. The slug removal problem is present also in these non-round opening applications. Accordingly, there is a need to develop apparatus for removing non-round slugs from their dies after forming with a punch, or to solve the problem by creating slugs which are per se more readily removable from the die, for example by producing a split slug as described above in connection with round hole punch and die sets.

The instantaneous force required to drive a punch through a sheet metal workpiece, for a given shaped opening, depends in some measure directly on the length of peripheral edge around the intended opening which is simultaneously being sheared. Thus, a flat die working face operates simultaneously around the entire periphery of the intended opening and requires considerable force. However, the punch travel is minimized.

Cutting edges which are set at an angle transverse to the direction of punch motion but not perpendicular thereto, reduce the required punching force by providing localized cutting rather than cutting around the entire periphery simultaneously. However, the reduction in force is accomplished with increased punch stroke. This force reducing technique is exemplified in the two above cited patents and in many other patents cited as prior art in those patent specifications.

As explained more fully hereinafter, the cutting edges in the U.S. Pat. No. 4,543,722, mentioned above, cause undesirable high force requirements when applied to non-round openings for punching with slug splitting. The desire to reduce required punch force in forming non-round openings requires that modification be made for some shapes in the tilt of the cutting surfaces relative to the direction of punch motion.

What is needed a non-circular slug splitter punch which is effective in reducing punch force requirements and provides a clean opening and a readily removable split slug.

SUMMARY OF THE INVENTION

Generally speaking, in accordance with the invention, a non-circular slug splitter punch especially suitable for reducing punching forces is provided. The die is conventional. The punch is comprised of peripheral cutting edges and lateral cutting edges. The peripheral edges cut out a slug in the desired shape, for example, rectangular, square, oval, trapezoidal, D and double D-shaped, etc. The lateral edges cut transversely from one peripheral edge to an opposite peripheral edge of the slug, thereby splitting the slug into at least two pieces. A pair of lateral cutting edges provide a dividing line across the working face of the punch. Generally, the surfaces and cutting edges on each side of the dividing line are similar although they are canted at opposite angles relative to imaginary planes and axes established herein for purposes of description. A stud clearance hole passes through the punch in the direction of punching, as is conventionally known, and separates the lateral cutting edges. On each side of the dividing line are the sloping surfaces. The outer cutting edges of these surfaces on one side of the dividing line define one-half of the contour of the intended opening and the corresponding, but oppositely sloped surfaces on the other side of the dividing line define the remainder of the opening to be cut from the workpiece.

A typical working embodiment of the invention includes a pair of inclined first surfaces oppositely disposed on the punch working face on opposite sides of the dividing line and sloping in opposite directions. The first inclined surfaces each have an outer peripheral edge forming a first outer cutting edge on opposite sides of the working face and extending partially around the working face periphery when viewed in plan. A pair of second inclined surfaces intersect respectively the first inclined surfaces and also slope toward the dividing line but a steeper angle of inclination. The second inclined surfaces each have an outer peripheral edge forming a second outer cutting edge contiguous with the respective first cutting edges, but, as indicated, more steeply inclined. In addition, the second inclined surfaces terminate along the dividing line in lateral inclined cutting surface which slope in opposite directions to intersect with the associated second outer cutting edges. The lateral cutting surfaces associated with the second surfaces on both sides of the dividing line together form a generally V-shaped lateral cutting means across the working face from one peripheral edge to the opposite peripheral edge of the intended opening.

Further, the lateral cutting surfaces and second cutting edges together at their juncture each provide a generally pyramidal cutting section. These cutting sections cut right angle patterns into the workpiece to initially pierce the workpiece and initiate lateral cutting or splitting of the slug. This split grows from the slug periphery toward a location within the slug periphery before a substantial portion of the slug periphery is cut. This priority cutting arrangement assures that the slug is adequately supported at the periphery while it is being split apart.

In a preferred embodiment of the invention, the inclined surfaces are planar and the first and second surfaces intersect along straight lines which run parallel with the dividing line. The lateral cutting surfaces may either substantially join one another at some location across the working face to form a unitary generally V-shaped lateral cutting means, or, as described above, the lateral cutting surface may extend from a peripheral edge of the punch to intersect with a stud clearance hole generally centered within the geometry of the punch.

Accordingly, it is an object of this invention to provide an improved punch which forms a non-round opening in sheet metal.

Another object of this invention is to provide an improved punch which forms a non-round opening and a slug which is split into at least two parts.

A further object of this invention is to provide an improved punch which has low operating force requirements and has extended life.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 2:
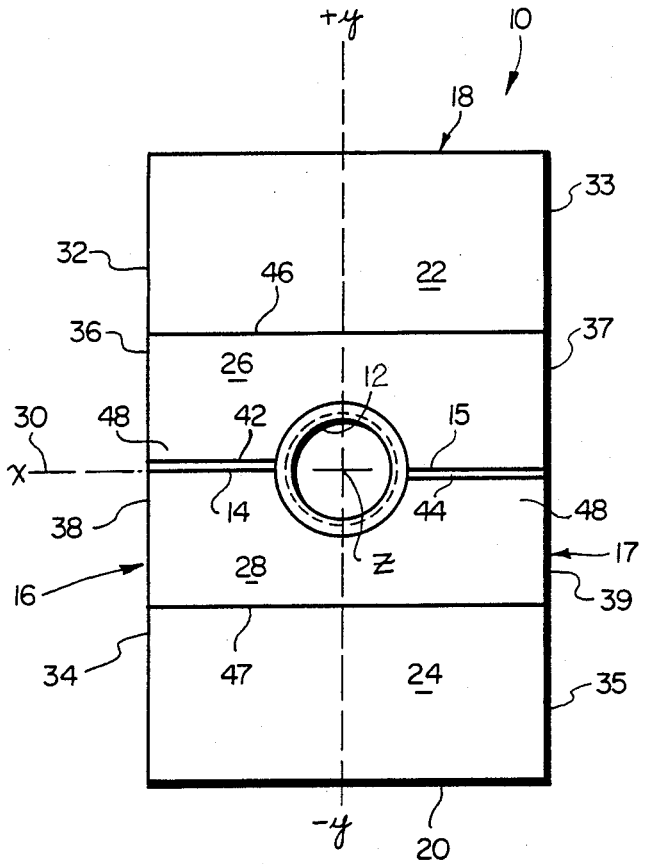
FIG. 2 is a top plan view of the punch of FIG. 1 showing a rectangular, peripheral outline and lateral cutting edges for slug splitting.

FIGS. 1–3 and 5, 6 illustrate a non-circular slug splitter punch 10 in accordance with the invention. The punch is intended to produce a rectangular opening in a sheet metal workpiece, said opening corresponding in shape with the outlines of the punch 10 as viewed in FIG. 2. In operation, the punch 10 is positioned in opposition to a die having a cavity of the same rectangular shape. The workpiece (not shown) is positioned between the working face of the punch 10 and the die cavity. A draw stud (not shown) passes through the central opening 12 in the punch 10, through a clearance opening in the workpiece, and then through a stud clearance hole in the die. A nut is tightened on the stud until the punch and die are drawn together, shearing the rectangular opening from the workpiece in the process. In the process, lateral cutting edges 14, 15 split the slug transversely to its long axis Y, along a line extending along the X axis from the central opening 12 to the long side edges 16, 17, respectively of the punch 10 and formed opening. Thus, a two-piece slug is produced.

The slug splitting punch now described in more detail with reference to the imaginary coordinate axes X, Y and Z. The Z axis passes through the center of the central opening 12 and represents the direction of motion as the punch is forced into the die, while shearing a workpiece, and is then withdrawn. Perpendicular to the Z axis and mutually perpendicular to each other, are the X and Y axes. These are conventional orthogonal XYZ axes used in three-dimensional representations. The long side edges 16, 17 of the die 10 lie parallel to the Y axis and the shorter end edges 18, 20 lie parallel to the X axis. The working face comprises a pair of first inclined surfaces 22, 24 and respectively contiguous second inclined surfaces 26, 28. As clearly illustrated in FIG. 2, the surfaces 22, 26 are on the opposite side of a punch dividing line 30 which in the top plan view projects coincidently with the X axis. The lateral cutting edges 14, 15 lie on the dividing line 30.

The first inclined surface 22 includes peripheral cutting edges 32, 18, 33. First inclined surface 24 includes peripheral cutting edges 34, 20, 35. Second inclined surfaced 26 includes peripheral cutting edges 36, 37 and second inclined surface 28 includes peripheral cutting edges 38, 39. Thus, the long side edge 16 includes cutting edges 32, 36, 38, 34 and long side edge 17 includes cutting edges 33, 37, 39, 35.

Figure 3:
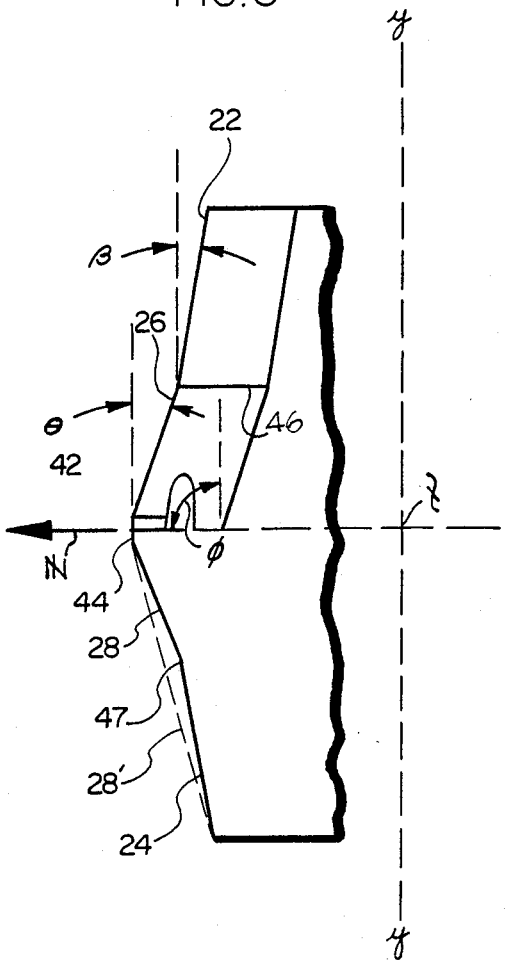
FIG. 3 is a partial side elevational view taken relative to FIG. 2.
Figure 1:
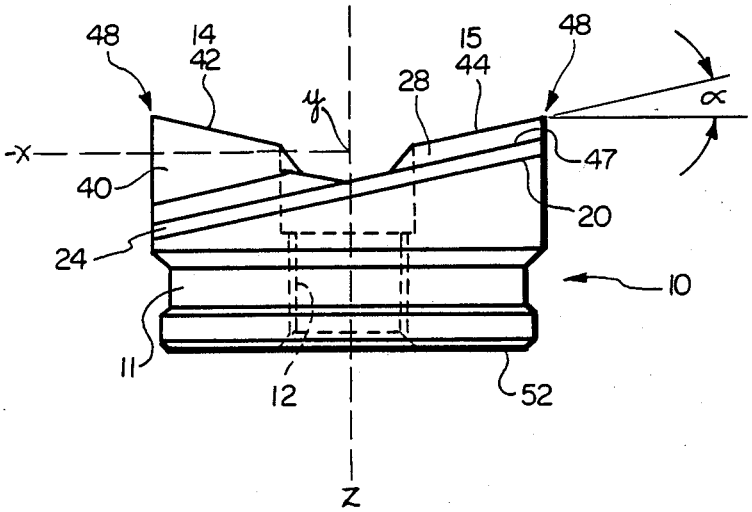
FIG. 1 is an elevational view of a non-round slug splitter punch in accordance with the invention.
Figure 6:
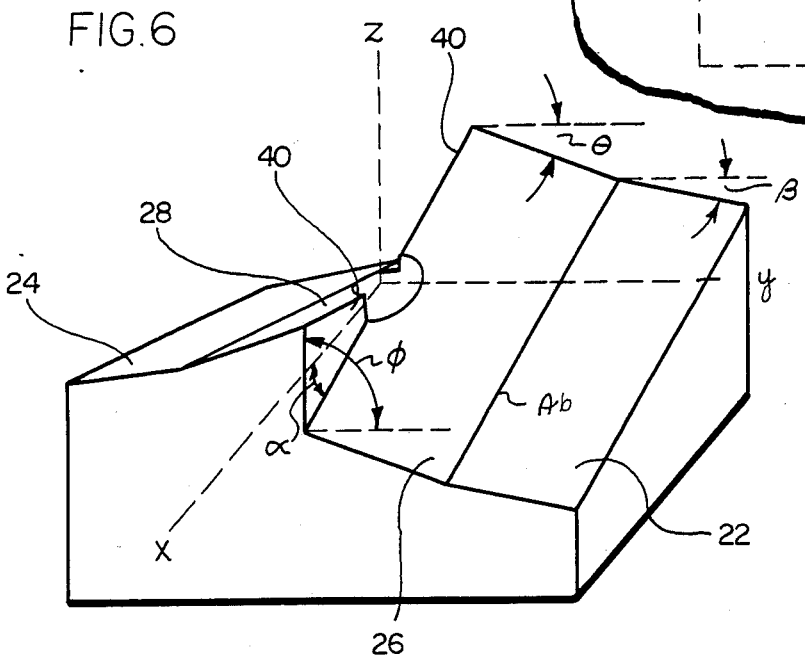
FIG. 6 is a perspective view illustrating the slopes of surfaces and cutting edges on the work face of the punch of FIG. 1 relative to each other and to imaginary surfaces and axes representing a plane parallel in the workpiece to be punched, and the direction of punch motion in operation.

As best illustrated in FIGS. 1, 3 and 6, the surfaces 22, 24, 26, 28, are inclined relative to the Z axis, that is, the direction of punch travel. The second surfaces 26, 28 are inclined by an angle $\alpha$ relative to the X, Y plane by rotation about the Y axis with the surface 26 being higher at the left side and lower at the right side, as illustrated in FIGS. 1 and 2. The surface 28 is inclined in exactly the opposite direction, that is, by an equal and opposite angle $\alpha$ relative to the X-Y plane. Additionally, the surfaces 26, 28 are rotated (FIG. 3) relative to the Y-Z plane by an angle $\theta$ by rotation about the X axis. The surface 28 is rotated in the opposite direction, that is, by an equal and opposite amount. This double sloped construction creates pyramid-like protrusions or high points 48 at opposite ends of the dividing line 30 and presents a generally V-type appearance in the elevational view of FIG. 1.

Unlike the corresponding surfaces in the circular punch in U.S. Pat. Nos. 4,543,722 and 4,353,164 referenced above, the primary surfaces 22, 24 are inclined relative to the surfaces 26, 28 respectively, that is relative to the X-Y plane by the angle $\beta$, each surface 22, 24 being inclined in the opposite direction by an equal but opposite angle $\beta$. Vertical surfaces 40 provide transitions between the inclined secondary surfaces 26, 28, that is, surfaces 40 which are parallel to the X-Z plane. Thus, the angle $\phi$ is 90° as illustrated.

Flat surfaces 42, 44 extend along the dividing line 30 coextensive with the lateral cutting edges 14, 15 in order to eliminate a sharp edge which would have a short operating life. The flat surfaces 42, 44 have been omitted in FIG. 6 for sake of clarity in illustration.

Because of the relatively different angles of slope $\theta$, $\beta$ for the first and second inclined surfaces, intersection lines 46, 47 are formed between those surfaces. The secondary surfaces 26, 28 are inclined at a steeper angle relative to the Z axis than are the primary or first inclined surfaces 22, 24. The slope of the lateral cutting edges 14, 15, that is, angle $\alpha$, is less than the slope of the secondary surfaces 26, 28, that is, angle $\theta$.

The interrelationship between the surfaces and their slopes is further clarified with reference to FIG. 6. If it is assumed for the sake of explanation that at the outset the surfaces 22 and 26 are joined at intersection line 46 and both surfaces 22, 26 lie in the plane of the X-Y axes and perpendicular to the X-Z plane, the final configuration is achieved as follows:

First, the surfaces 22, 26 are rotated together about the Y axis by an angle $\alpha$ relative to the X-Y plane. Then, the surface 26 is rotated about its edge, which lies in a plane parallel to the X-Z plane, through an angle $\theta$ while the surface 22 is kept perpendicular to the X-Z plane. The surface 22 is then rotated around the intersection line 46 by the angle $\beta$. The first and second inclined surfaces on the opposite side of the intersection line are oriented in the opposite direction by equal and opposite angles. As clearly illustrated in FIG. 6, the vertical surfaces 40 join the lateral cutting edges 14, 15 to the surfaces 26, 28.

Figure 5:
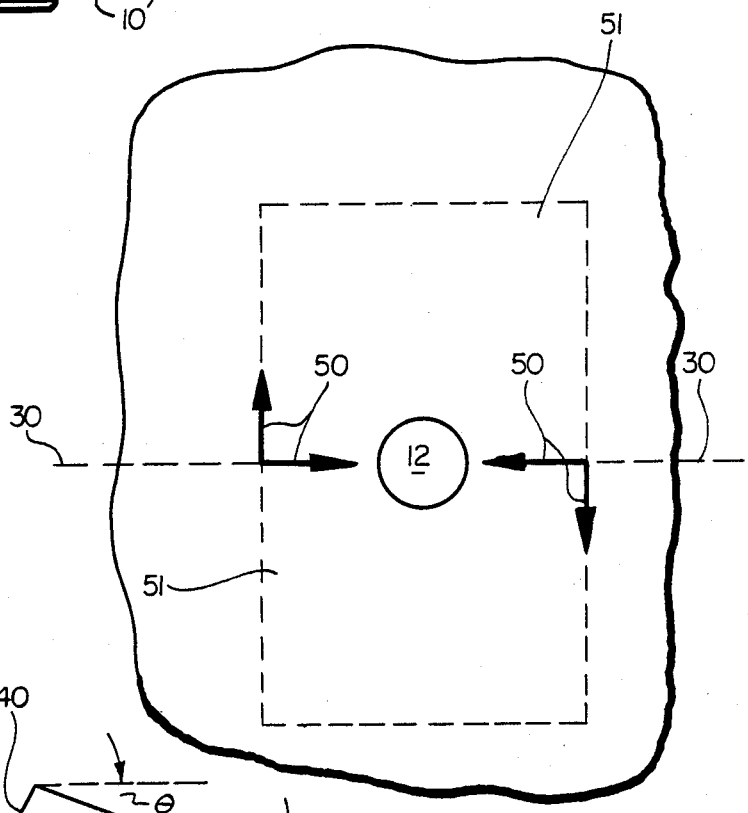
FIG. 5 is a top plan view of a workpiece showing initial cuts from the punch of FIG. 1 shearing into the workpiece.

In operation, when the punch 10 is moved in the Z direction against the workpiece (not shown), the high points 48 on opposite ends of the dividing line 30, make first contact and first penetration of the workpiece. As the punch continues to move, the peripheral cutting edges 36, 39 begin cutting on opposite sides and in opposite directions along the periphery of the intended slug and the lateral cutting edges 14, 15 begin cutting toward the central opening 12. This is illustrated in FIG. 5. Because the slope $\alpha$ of the lateral cutting edges 14, 15 is less than angle $\theta$ the slope of the cutting edges 36, 39, cutting proceeds more rapidly laterally toward the center opening 12 than along the side peripheral edges. Because the surfaces 40 are parallel to the punch motion, there is no cutting peripherally in both directions away from the centerline 30 at initial penetration of the high points 48 and bidirectional peripheral cutting does not begin until the lateral cutting, which splits the slug, is entirely completed. Thus, while the lateral cutting takes place, the slug is always supported at its peripheral edge. This support makes possible complete lateral cutting right to the center. Cutting continues along the periphery proceeding in opposite directions on opposite sides, until the intended slug has been split. Sometime thereafter, depending upon the dimensions of the intended slug and the slopes $\alpha$, $\theta$, cutting will commence at the dividing line 30 proceeding in the opposite direction from the original cutting, until cutting is completed at the diagonally opposite corners 51 of the slug.

The arrows 50 in FIG. 5 are intended to indicate the initial location and direction of cutting and velocity of cutting by their direction and length respectively, as in vectorial representation.

In punches which perform satisfactorily, $\alpha$ is in a range of 10°–15°, preferably at 13° for a square hole punch; $\theta$ is in a range of 15–25° and preferably 20°; is 90° and $\beta$ is in a range of 10°–15°, preferably 13°. It should be noted that with $\alpha$ equal to 13° and $\theta$ equal to 20°, initial cutting in the lateral direction is approximately 70% greater in velocity than in the peripheral direction (compared angle tangents), assuring completion of the lateral slug splitting cut before substantial peripheral support is lost.

Figure 7:
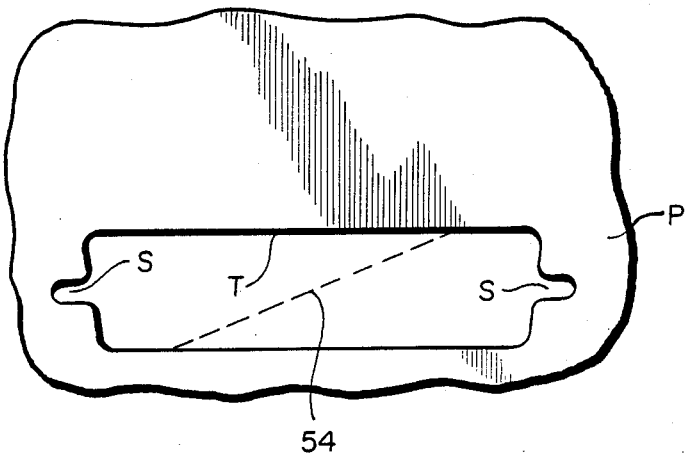
FIG. 7 shows an opening for an electrical connector which may be produced by a slug splitting punch in accordance with the invention.
Figure 8A:
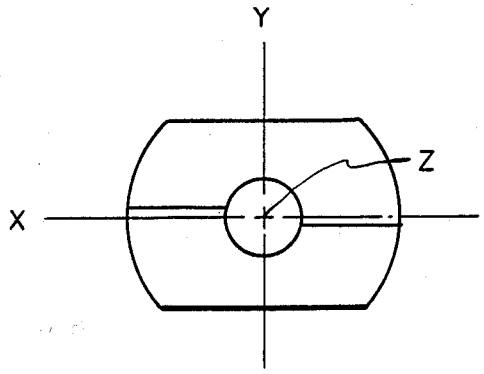
FIG. 8*a* is an alternative embodiment of a slug splitter punch having a double D shape in accordance with the invention.
Figure 8B:
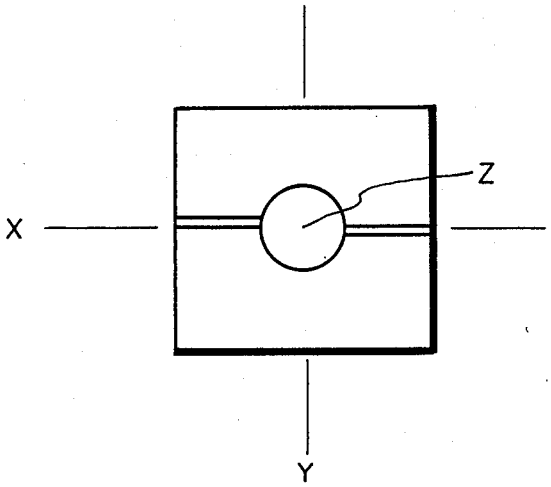
FIG. 8*b* is another alternative embodiment showing a square-shaped punch in accordance with the invention.

This slug splitting construction has been applied successfully to forming square openings in sheet metal and openings which are rounded at both ends (double-D) as illustrated in FIG. 8, and for electrical connectors as illustrated, for example, in FIG. 7. In all of these applications, effective performance has been achieved when the dividing line, that is, the line of lateral cutting for slug splitting, extends basically parallel to the long axis of the opening. However, in alternative embodiments of the invention, the lateral cutting can be along the shorter axis between the sides (FIG. 2). And in additional alternative embodiments, the slug splitting action can take place along any diagonal, for example, between opposed corners or at any angle around the Z axis (FIG. 2).

The angle $\phi$ can be greater than 90° which as seen in a view similar to FIG. 5, would produce peripheral cutting simultaneously in both directions away from a dividing line 30. The associated angle $\alpha$ is selected to assure sufficient support at the peripheral cutting edges to assure slug splitting rather than mere slug bending by the lateral cutting edges 14, 15.

Angled slug splitting, for example, along the broken line 54, for forming openings as illustrated in FIG. 7 may be especially effective where the ears S of the opening present a problem if splitting was done parallel to the long axis of the opening.

Figure 4:
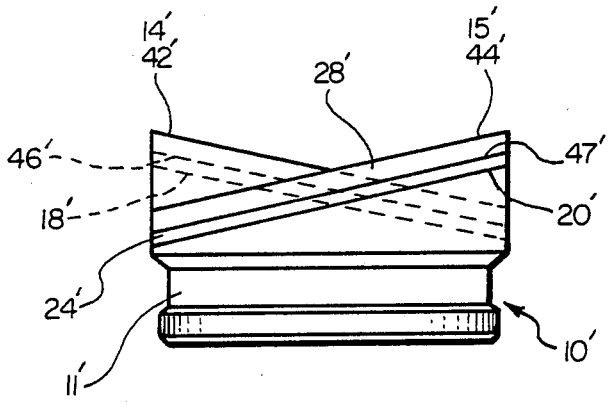
FIG. 4 is an elevational view similar to FIG. 1 of an alternative embodiment of a punch in accordance with the invention wherein the lateral cutting surfaces meet at the center.

As in U.S. Pat. Nos. 4,543,722 and 4,353,164 cited above, punches of similar construction can be made without the central clearance hole 12 for a draw stud. In such case (FIG. 4), the second inclined surfaces 26', 28', lateral cutting edges 14', 15' and flat surfaces 42', 44' extend to the center of the punch.

It should also be understood that the first 22, 24 and second inclined surfaces 26, 28 need not be planar as illustrated, but may be curved to change the force distance characteristics in punching for different slug outlines. Also, the slopes of the surfaces need not be continuous from one peripheral edge to the other peripheral edge and a curvature in the surfaces need not be of one radius. Thus, the cutting periphery in plan view as in FIG. 2, always defines the slug outline, but in elevational views (FIGS. 1 and 3), the cutting edges will not necessarily appear as straight lines when the associated surfaces are not planar or continuous.

Also in alternative embodiments in accordance with the invention, the angles $\alpha$ may differ in magnitude on opposite sides of the dividing line 30. As a result one high point 48 may be farther from the base 52 than the other. Thereby force requirements may be reduced at the expense of further punch motion.

Further, in another alternative embodiment angles $\theta$ and B may be equal, effectively providing only one inclined planar surface 26, 28 on each side of the dividing line 30 as indicated by the broken line 28, in FIG. 3.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A punch for use with a die producing a slug in at least two pieces when forming a non-round opening in a workpiece positioned between said punch and die, said non-round opening and said at least two-piece slug being cut by movement of said punch and die toward each other in a direction along a Z axis, said punch having a working face which when viewed along said Z axis corresponds in shape with said opening, said working face being definable as having an X axis and a Y axis perpendicular to said plane, said X and Y axes extending respectively from the peripheral edge at one side of said face to the peripheral edge at the opposite side of said face, said X axis defining a dividing line for said working face as viewed in the direction of the Z axis, said working face comprising:

a pair of first inclined surfaces disposed on opposite sides of said dividing line and sloping in opposite directions at an angle $\alpha$ relative to said X-Y plane as viewed in the X-Z plane and in the direction of the Y axis, said first surfaces being at a non-zero angle $\beta$ relative to said X-Y plane when viewed in the Y-Z plane and in the direction of the X axis, said first surfaces each having an outer periphery forming a first outer cutting edge on opposite sides of said dividing line;

a pair of second inclined surfaces each joining with a respective one of said first inclined surfaces, said second surfaces being inclined at said angle $\alpha$ relative to said X-Y plane as viewed in the X-Z plane and in the direction of the Y axis, said second inclined surfaces being inclined at a non-zero angle $\theta$ relative to said X-Y plane when viewed in the Y-Z plane and in the direction of the X axis, said second inclined surfaces each having an outer periphery forming a second cutting edge contiguous with the respective first cutting edges on opposite sides of said dividing line;

a pair of lateral cutting edges extending along said X axis inwardly from opposite ones of said peripheral edges, said second inclined surfaces each terminating at a respective one of said lateral cutting edges; and third surfaces associated with each said lateral cutting edge and connecting respectively between said cutting edges and said second inclined surfaces.

2. A punch as claimed in claim 1, wherein said lateral cutting edges are oppositely inclined at said angle $\alpha$ with respect to said X-Y plane as viewed in the direction of the Y axis.

3. A punch as claimed in claim 2, wherein said lateral cutting edges are narrow, flat edges.

4. A punch as claimed in claim 2, wherein $\alpha$ is less than $\theta$ and said third surfaces are oriented relative to said Z axis such that initial cutting by said lateral cutting edges proceeds faster in the lateral direction than cutting along the periphery of said opening, said slug being split before said opening in said workpiece is completed.

5. A punch as claimed in claim 2, wherein $\beta$ equals $\theta$.

6. A punch as claimed in claim 1, wherein said first and second inclined surfaces are planar.

7. A punch as claimed in claim 6 and further comprising a stud clearance hole passing through said working face in said Z direction, said clearance hole being centered along said X axis.

8. A punch as claimed in claim 7, wherein said third surfaces are planar and parallel to said Z axis.

9. A punch as claimed in claim 7, wherein $\beta$ equals $\theta$.

10. A punch as claimed in claim 6, wherein $\alpha$ is in a range of 10°–15°, $\theta$ is in a range of 15°–25° and $\beta$ is in a range of 10°–15°.

11. A punch as claimed in claim 10, wherein $\alpha$ is 13°, $\theta$ is 20° and $\beta$ is 13°.

12. A punch as claimed in claim 11, wherein said third surfaces are planar and parallel to said Z axis.

13. A punch as claimed in claim 1 and further comprising a stud clearance hole passing through said working face in said Z direction, said clearance hole being centered along said X axis.

14. A punch as claimed in claim 13, wherein said stud hole separates one said lateral cutting edge from the other said lateral cutting edge.

15. A punch as claimed in claim 1, wherein said third surfaces are planar and parallel to said Z axis.

16. A punch as claimed in claim 1, wherein $\alpha$ is in a range of 10°–15°, $\theta$ is in a range of 15°–25° and $\beta$ is in a range of 10–15°.

17. A punch as claimed in claim 16, wherein $\alpha$ is 13°, $\theta$ is 20° and $\beta$ is 13°.

18. A punch as claimed in claim 1, wherein said pair of lateral cutting edges terminate inwardly where said second inclined surface on one side of said dividing line crosses said second inclined surface on the other side of said dividing line.

19. A punoh as claimed in claim 1, wherein $\beta$ equals $\theta$.

* * * * *

UNITED STATES PATENT AND TRADEMARK OFFICE

CERTIFICATE OF CORRECTION

PATENT NO. : 4,905,557

DATED : March 6, 1990

INVENTOR(S) : Larry Adleman

It is certified that error appears in the above-identified patent and that said Letters Patent is hereby corrected as shown below:

Column 5, Line 68 from " 20°; is 90°" to -- 20°; $\phi$ is 90°--

Column 6, Line 62 from " broken line 28, in to -- broken line 28' in --

Column 7, Line 20 from " perpendicular to said plane, said X and Y " to -- perpendicular to each other in a plane, said Z axis being perpendicular to said plane, said X and Y --

Column 8, Line 37 from " said stud hole " to -- said stud clearance hole --

Column 8, Line 52 from " A punoh " to -- A punch --

Signed and Sealed this

Fifteenth Day of October, 1991

*Attest:*

*Attesting Officer*

HARRY F. MANBECK, JR.

*Commissioner of Patents and Trademarks*